US005702341A

United States Patent [19]

Keilhau

[11] Patent Number: 5,702,341

[45] Date of Patent: Dec. 30, 1997

[54] FOLDER FOR SELECTIVELY PRODUCING ONCE OR TWICE CROSS-FOLDED PRODUCTS

[75] Inventor: Theo Keilhau, Neusäss, Germany

[73] Assignee: MAN Roland Druckmaschinen AG, Offenbach am Main, Germany

[21] Appl. No.: 635,695

[22] Filed: Apr. 22, 1996

[30] Foreign Application Priority Data

Apr. 26, 1995 [DE] Germany ..... 195 15 268.9

[51] Int. Cl.[6] ..... B65H 45/16

[52] U.S. Cl. ..... 493/426; 493/430; 271/303

[58] Field of Search ..... 493/424, 425, 493/426, 427, 428, 429, 430, 431, 432, 433, 434, 435, 436, 419, 420, 421; 271/303, 384

[56] References Cited

U.S. PATENT DOCUMENTS

| | | | |
|---|---|---|---|
| 2,131,363 | 9/1938 | Barber . | |
| 2,138,054 | 11/1938 | Zuckerman . | |
| 2,164,370 | 7/1939 | Zuckerman . | |
| 4,697,805 | 10/1987 | Herb | 493/424 |
| 4,817,932 | 4/1989 | Stab | 493/424 |
| 5,004,451 | 4/1991 | Prum | 493/424 |
| 5,076,556 | 12/1991 | Mandel | 493/421 |
| 5,226,871 | 7/1993 | Skipor | 493/427 |
| 5,263,708 | 11/1993 | Hacknauer | 271/303 |
| 5,425,697 | 6/1995 | Lanvin | 493/426 |
| 5,547,452 | 8/1996 | Kepert | 493/427 |

FOREIGN PATENT DOCUMENTS

| | | | |
|---|---|---|---|
| 0271684 | 9/1989 | Germany | 493/430 |
| 4318133 | 1/1994 | Germany . | |

*Primary Examiner*—Joseph J. Hail, III
*Assistant Examiner*—Christopher W. Day
*Attorney, Agent, or Firm*—Cohen, Pontani, Lieberman & Pavane

[57] ABSTRACT

In order to set the sheet guidance devices of a folder simply and quickly for the production of once or twice cross-folded products and to guide the products reliably and carefully, a tongue and a tongue bar are arranged in the runout gap of the folding blade cylinder and gripper/folding knife cylinder. To produce twice cross-folded products, the tongue can be moved out of the runout gap, after which a guidance device with a somewhat arc-shaped contour is directed to the runout gap.

9 Claims, 4 Drawing Sheets

FOLDER FOR SELECTIVELY PRODUCING ONCE OR TWICE CROSS-FOLDED PRODUCTS

BACKGROUND OF THE INVENTION

1. Field of the Invention

The invention relates to a folder for the selective production of once or twice cross-folded products.

2. Detailed Description of the Prior Art

By using special folders, it is possible to produce products that are cross-folded either once or twice. Depending on whether the products are produced with only a first cross-fold or with a first and a second cross-fold, i.e., on whether they are cross-folded once or twice, the sheet guidance varies. Products with one cross-fold are guided further on the jaw cylinder, while products with two cross-folds, are turned over to the grippers of a gripper/folding knife cylinder and are then pressed, during the production of the second cross-fold, into a folding jaw of the jaw cylinder. The sheet guidance devices in the runout gap of the jaw cylinder and the gripper/folding knife cylinder vary accordingly.

When production is switched from products with one cross-fold to products with two crossfolds or vice versa, in the general prior art it is necessary to remove the tongues in the runout gap between the jaw cylinder and the gripper/folding knife cylinder and replace them with different ones. However, this exchange is time-consuming and often difficult, for example, when the tongues are only accessible through what are often very narrow assembly openings.

According to DE 43 18 133 A1, the tongue for producing the second cross-fold remains continuously installed in the runout gap between the jaw cylinder and the gripper/folding knife cylinder. In order to produce products folded only once, belts that wrap around the gripper/folding knife cylinder are pressed against the jaw cylinder. This procedure has the disadvantage that the tongues must be provided with very wide gaps, because space must be created not only for the gripper but also for the aforementioned belts. At higher speeds, the wide gaps have a negative impact on the products and can cause marks on the products.

SUMMARY OF THE INVENTION

Accordingly, it is an object of the present invention to provide a folder having sheet guidance devices that can be adjusted quickly and simply to produce products cross-folded once or twice and that guide the products reliably and carefully.

Pursuant to this object and others which will become apparent hereafter, one aspect of the present invention resides in a folder having a jaw cylinder with at least two equally spaced folding jaws arranged at its perimeter. A gripper/folding knife cylinder is arranged adjacent to the jaw cylinder so as to define a runout gap therebetween. A tongue is configured to guide a sheet in the runout gap and has a guide area approximately concentric relative to the jaw cylinder. A tongue bar is arranged behind the tongue and has a guide surface that is approximately concentric relative to the gripper/folding knife cylinder. The tongue is moved into and out of the runout gap by moving means. Additionally, a guiding device having a somewhat arc-shaped contour that is directed towards the runout gap is arranged behind the tongue so when the moving means moves the tongue out of the runout gap the guide device faces the runout gap.

In a further embodiment of the invention the tongue bar has a recess in its guide surface. The moving means swings the tongue out of the runout gap into the recess of the tongue bar when twice-cross-folded products are being produced. The tongue and the tongue bar are connected to moveable walls so as to permit movement of the tongue and the tongue bar away from the gripper/folding knife cylinder.

Yet another embodiment of the invention includes a shaft rotatable mounted to the moveable walls. The tongue is attached to the shaft and a drive is provided for rotating the shaft along with the tongue.

In still another embodiment of the invention the drive for the shaft includes a lever attached to each end of the shaft, a crank is mounted on the moveable wall, coupling means are provided for connecting the lever to the crank, and a working cylinder is swingably mounted to the wall and connected to the crank.

In a further embodiment of the invention each wall includes a sidewall mounted parallel to the wall. Two parallel, equal length levers are rotatably mounted in articulated fashion on the sidewall, and a working cylinder is articulated to the sidewall and connected to the wall.

The guidance devices of the folder can be switched quickly and easily from production with one cross-fold to production with two cross-folds and vice versa. To do this, no guidance devices need to be exchanged. The guidance devices used, tongues and tongue bars, have only narrow gaps, which are traversed only by grippers. As a result, products are guided reliably and carefully even at high speeds.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
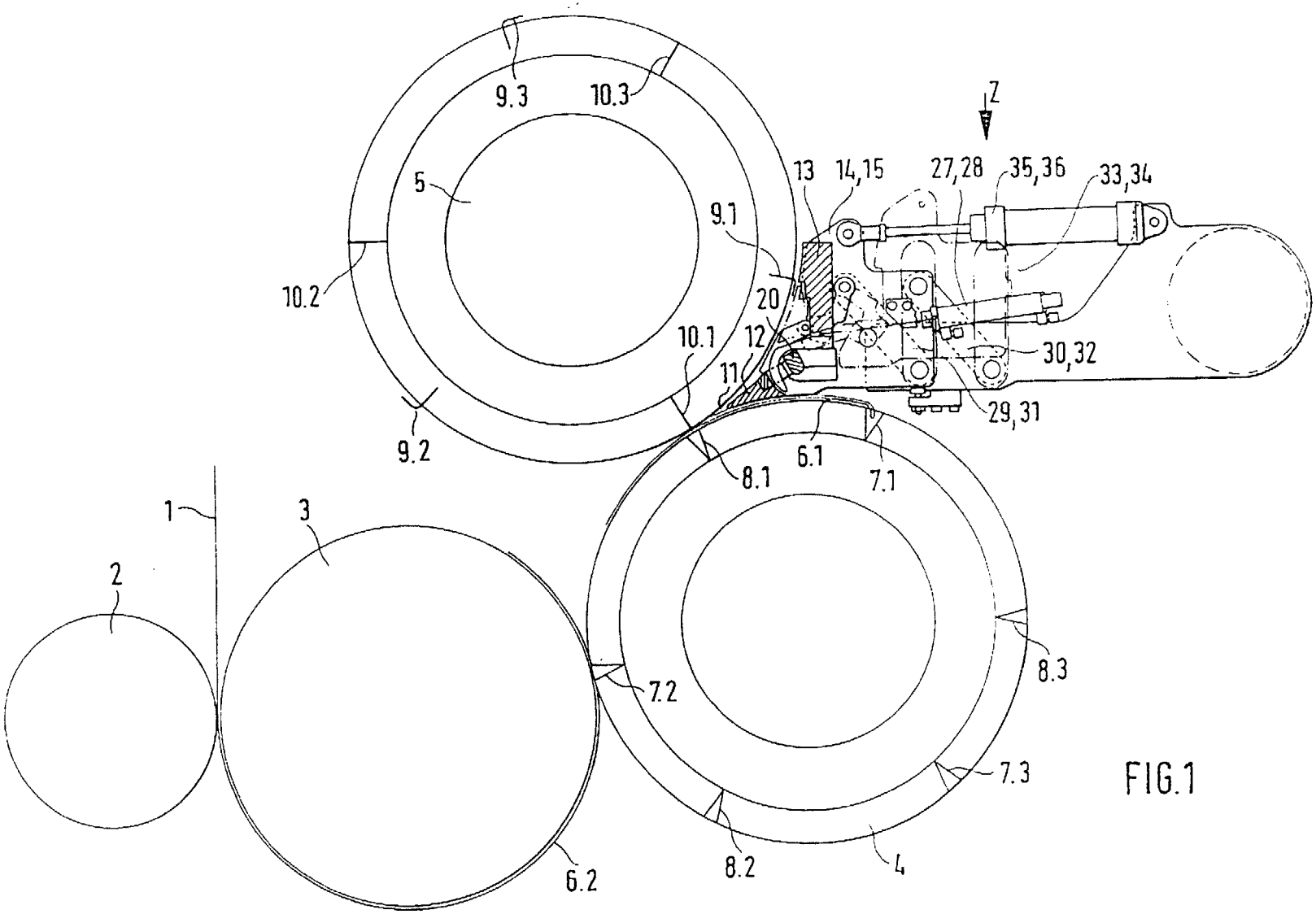
FIG. 1 is a side view of a folder with a jaw cylinder and a gripper/folding knife cylinder, pursuant to the present invention.

The folder shown in FIG. 1 is used for the optionally producing once or twice cross-folded products from a web 1. The folder includes a cutting cylinder 2, a point/folding knife cylinder 3, a jaw cylinder 4, and a gripper/folding knife cylinder 5. Upon traversing the cutting cylinder 2 and the point folding knife cylinder 3, the web 1 is cut into sheets 6.1, 6.2 which are turned over to one of the folding jaw 7.1, 7.2, 7.3 of the jaw cylinder for forming the first cross-fold. This is known in the art and is not part of the invention. Therefore, it will not be discussed here in greater detail.

Seen in the direction of rotation of the jaw cylinder 4, each folding jaw 7.1, 7.2, 7.3 is followed by another folding jaw 8.1, 8.2, 8.3. These folding jaws 8.1, 8.2, 8.3 serve to produce a second cross-fold and have, relative to the folding jaws 7.1, 7.2, 7.3, a perimeter spacing that corresponds to the spacing between the first and the second cross-folds of the product. In the example shown, the jaw cylinder 4 is designed in three-part fashion; i.e., three sets of folding jaws 7.1, 7.2, 7.3 and 8.1, 8.2, 8.3 are arranged at regular intervals on the perimeter. The jaw cylinder 4 could also be designed in a four-part or five-part manner, for example. The gripper/folding knife cylinder 5 is also designed in three parts. On its perimeter, it carries three evenly distributed grippers 9.1, 9.2, 9.3 and folding knives 10.1, 10.2, 10.3, which work together with the folding jaws 7.1, 7.2, 7.3 and the folding jaws 8.1, 8.2, 8.3. The gripper/folding knife cylinder 5 can also be divided differently, for example, into four or five parts.

Figure 2:
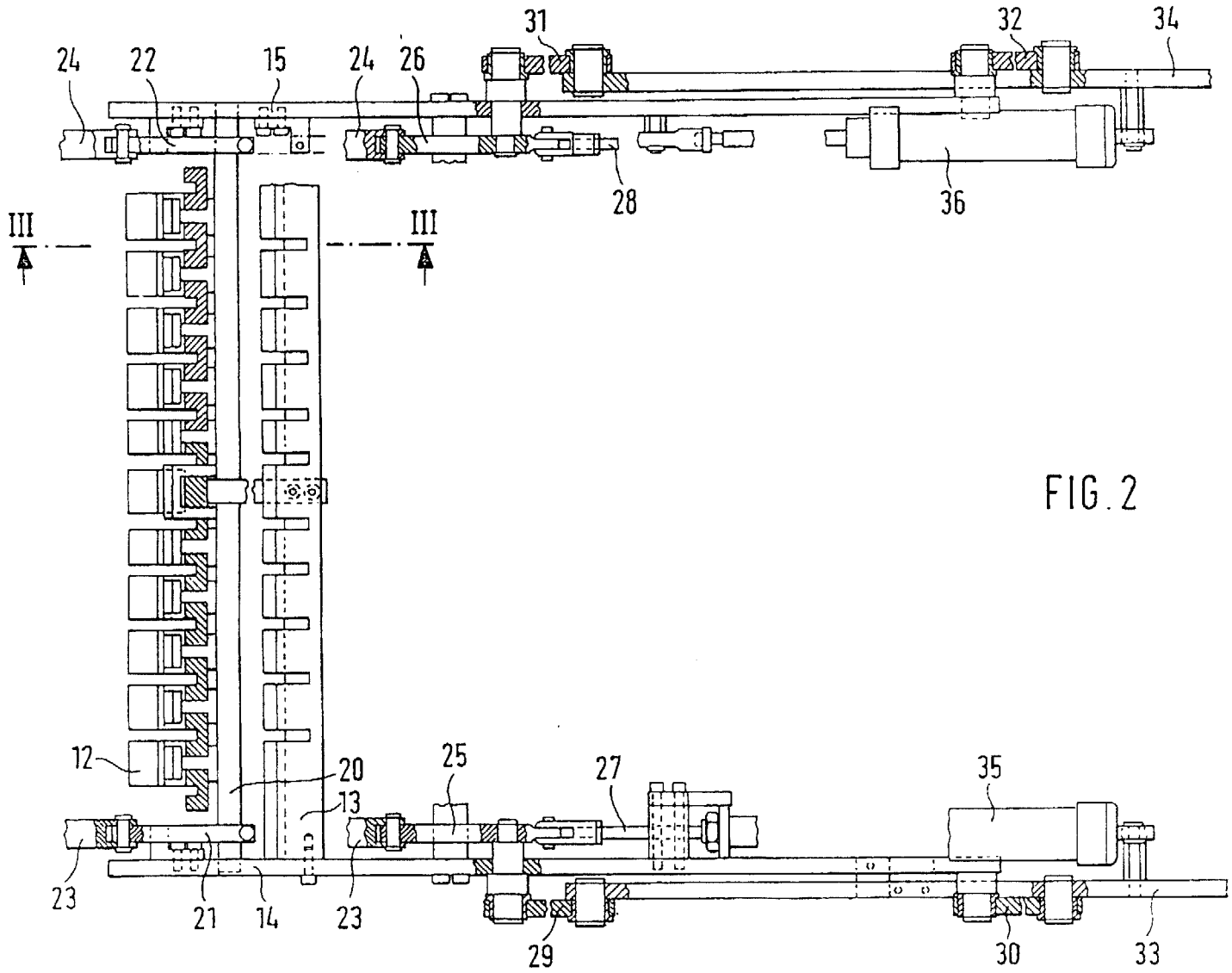
FIG. 2 is a view along the arrow Z in FIG. 1.
Figure 4:
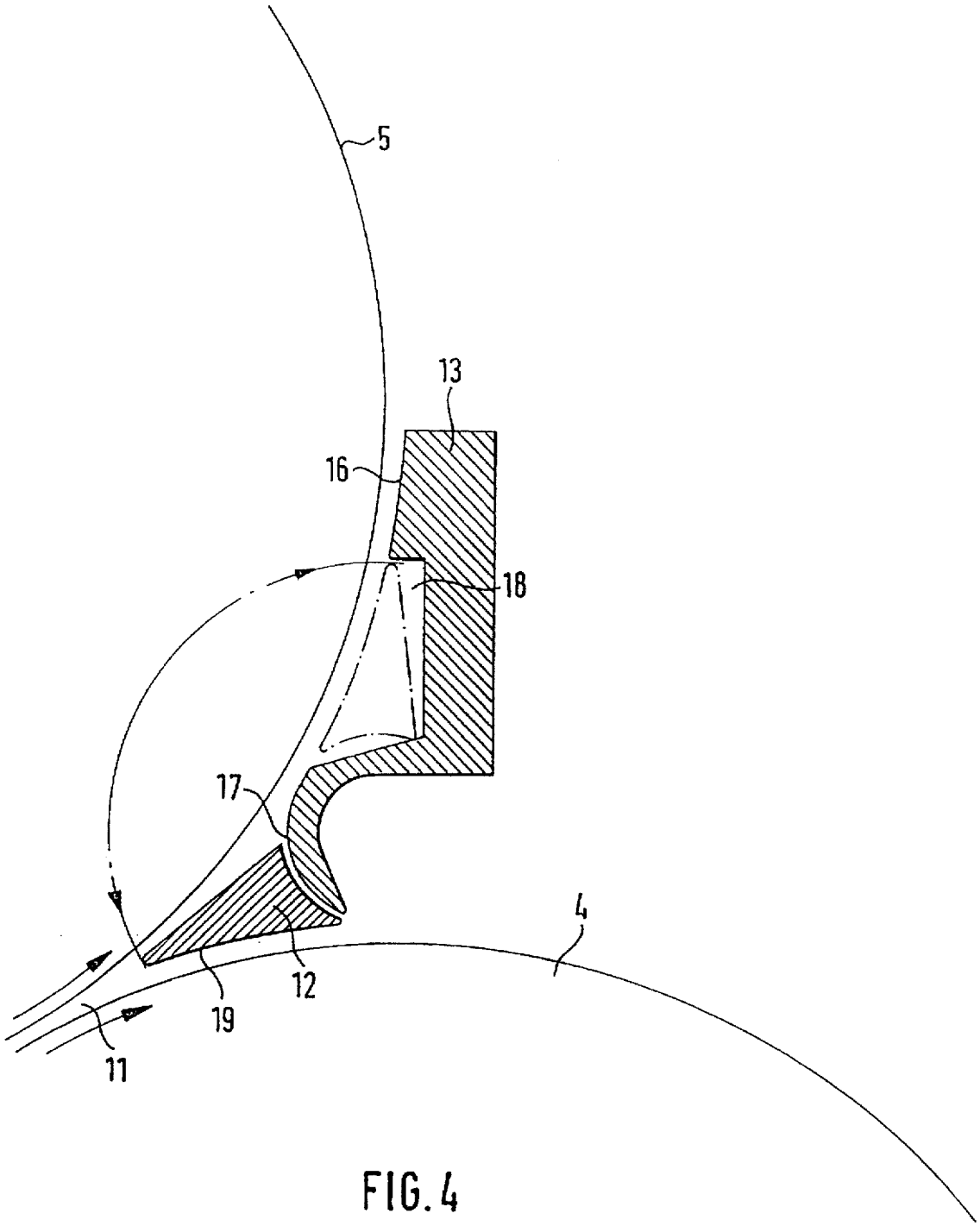
FIG. 4 is the Section III—III, showing only the tongue member and the tongue bar.

A tongue 12 and a tongue member bar 13 are arranged in the runout gap 11 of the jaw cylinder 4 and the gripper/folding knife cylinder 5, and serve to guide the sheets. The tongue bar 13 is screwed at its ends to walls 14, 15 (FIG. 2). The bar 13 has a guide area 16 lying approximately concentric relative to the gripper/folding knife cylinder 5 as well as a roughly arc-shaped contour 17 directed toward the runout gap 11 (FIG. 4). The tongue bar 13 is also provided with a recess 18 into which the tongue 12 can be swung. The tongue member 12 has a guide area 19 which, depending on the position into which it is swung, is directed toward the jaw cylinder 4 or supplements the guidance area 16 created by the recess 18.

To allow the tongue member 12, which consists of individual segments, to be swung, it is attached to a shaft 20 that is rotatably mounted to the walls 14, 15. At the respective end regions of the shaft 20, levers 21, 22 are attached, which are respectively connected, via couplings 23, 24, to cranks 25, 26 that are also rotatably mounted on the walls 14, 15. Working cylinders 27, 28 are connected to the cranks 25, 25 and rest in swingable fashion against the walls 14, 15.

The walls 14, 15 rest in an articulated fashion against two respective parallel levers of equal length 29, 30 and 31, 32, which are rotatably mounted in articulated fashion on respective side walls 33, 34. Each wall 14, 15 is acted upon by a working cylinder 35, 36 that is articulated to one of the side walls 33, 34.

Figure 3:
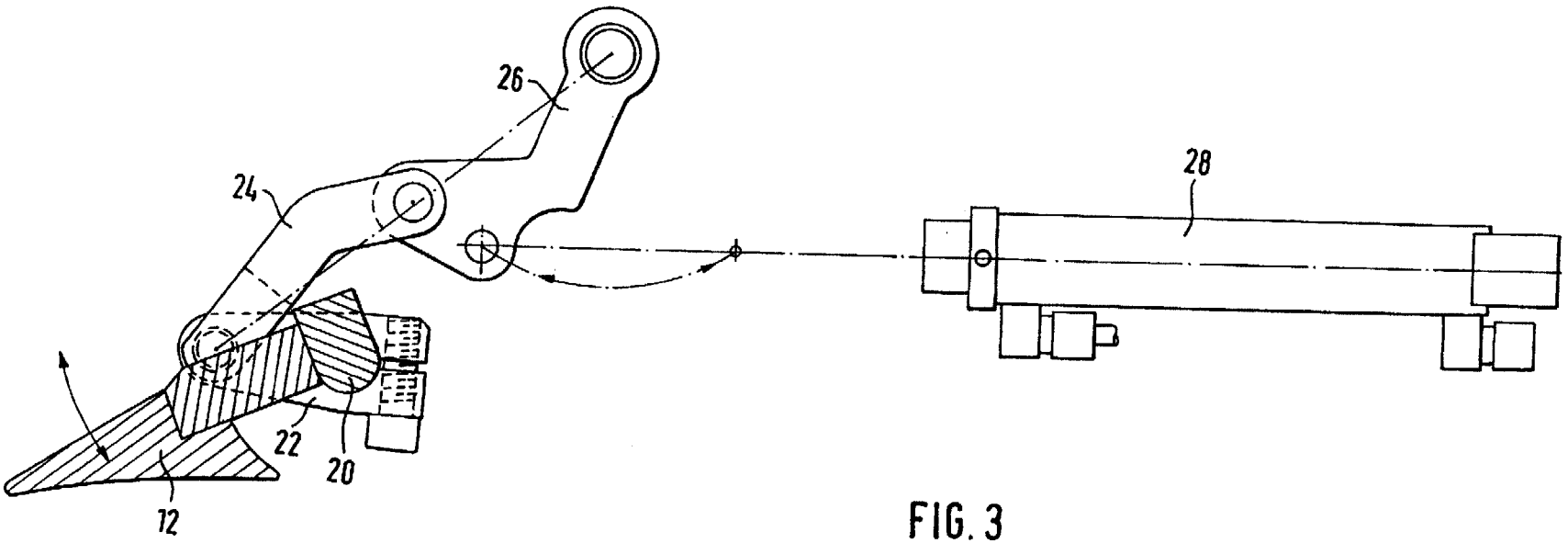
FIG. 3 is a Section along the line III—III in FIG. 2, not showing the tongue bar.

In the pictured position of the tongue member 12 in the runout gap 11, the folder is set for production of products with one cross-fold. In this case, the gripper/folding knife cylinder 5 and its functional elements, the grippers 9.1, 9.2, 9.3 and the folding knifes 10.1, 10.2, 10.3, are not activated. The product 6.1 with a single cross-fold is guided on the jaw cylinder 4 while being held in the folding jaw 7.1 and passed to a delivery device (not shown) or a third-fold device. As this is done, the tongue member 12 ensures by means of its guidance area 19 that the product 6.1 is guided reliably on the jaw cylinder 4. The tongue member 12 is reliably held in the depicted position by the levers 21, 22, the couplings 23, 24 and the cranks 25, 26, in that the cranks 25, 26 assume an over-dead-center position (FIG. 3). When this is done, retractive forces of the tongue member 12 do not press on the extended piston rods of the working cylinders 27, 28. Like the working cylinders 35, 36, the working cylinders 27, 28 are operated pneumatically or hydraulically.

Other drives can also act upon the shaft 20, for example, rotatory pneumatic or hydraulic working cylinders, i.e., working cylinders with an arc-shaped cylinder. Working cylinders or tractive magnets can also be directly connected to the levers 21, 22. The shaft 20 could also carry a toothed gear that is in drive-connection with a motor, the rotational direction of which is reversible. If an irreversible worm-worm wheel drive is used, the irreversibility can be used advantageously to secure the position of the tongue member 12.

To switch to production of twice-folded products, the tongue member 12 is swung into the position shown by the dash-dotted line in FIG. 4. However, first the tongue member 12 and the tongue bar 13 are moved away from the gripper/folding knife cylinder 5. This is done by reversing the working cylinders 35, 36, as a result of which the walls 14, 15, together with the tongue member 12 and the tongue bar 13, guided on the levers 29–32, carry out a swinging movement. The working cylinders 27, 28 are then reversed, as a result of which the shaft 20 is swung via the cranks 25, 26, the couplings 23, 24 and the levers 21, 22, so that the tongue 12 is moved into the recess 18 of the tongue bar 13. As this is done, the tongue member 12 disengages the arc-shaped contour 17 of the tongue bar 13 and forms with its guidance area 18, aligned with the guidance area 16 of the tongue bar 13, a common guidance area for the gripper/folding knife cylinder 5. By reversing the working cylinders 35, 36, the tongue bar 13 and the tongue member 12 are then again moved toward the gripper/folding knife cylinder 5.

Upon traversal of the connecting line of the centers of the jaw cylinder 4 and the gripper/folding knife cylinder 5, the folding jaw 7.1 releases the product (this type of production is not shown), which is then gripped at the first cross-fold by the gripper 9.1 and held securely and transported on the gripper/folding knife cylinder 5. The folding knife 10.1 then produces the second cross-fold in the folding jaw 8.1 and turns the product over to the jaw cylinder 4. After being released at the gripper 9.1, the product is transported furtheron the jaw cylinder 4. The released part of the product is carefully fed to the jaw cylinder 4 by means of the guidance area 16, the tongue member 12 located in the recess 18, and the arc-shaped contour 17. It is possible to convey the product with care because the guidance areas of the tongue bar 13 and the tongue member 12 have only narrow gaps, which are traversed only by the grippers 9. The twice cross-folded product can be provided with a delta fold or a double-parallel fold.

Using suitable guidance means, it is also possible to move the tongue bar 13 and the tongue member 12 away from or toward the gripper/folding knife cylinder 5 on a straight line or a curved path. Furthermore, it is possible to move the tongue member 12 out of the runout gap, for example, by means of a movement into the tongue bar 13. In this case, the back-and-forth movement of the tongue bar is not necessary. It is also possible for the arc-shaped contour 17 molded on the tongue bar 13 to be embodied by an independent guidance device to be guided into the runout gap 11. The repositioning of the tongue is advantageously carried out by means of a memory-programmable control device.

The invention is not limited by the embodiments described above which are presented as examples only but can be modified in various ways within the scope of protection defined by the appended patent claims.

I claim:

1. A folder for selectively producing once or twice cross-folded product, comprising:

a jaw cylinder having a first perimeter with at least two folding jaws arranged thereon with a perimeter spacing that corresponds to the spacing between the first and the second cross-folds of the product;

a gripper/folding knife cylinder having a second perimeter arranged adjacent to the jaw cylinder so as to define a runout gap between the first and second perimeters;

a tongue member configured to guide a sheet in the runout gap, the tongue member having a guide area approximately concentric relative to the jaw cylinder such that the guide area is complementary to the first perimeter of the jaw cylinder when the tongue member is positioned in the runout gap;

a tongue bar arranged behind the tongue member and having a guide surface approximately concentric relative to the gripper/folding knife cylinder such that the guide surface is complementary to the second perimeter of the gripper/folding knife cylinder;

means for moving the tongue member into and out of the runout gap such that when the tongue member is positioned in the runout gap a product is directed between the jaw cylinder first perimeter and said tongue member guide area of the tongue member for the production of products with one cross-fold and when the tongue is out of the runout gap a product is directed between said gripper/folding knife cylinder and said tongue bar guide surface for the production of products with two cross-folds; and a guide device having a substantially arc-shaped contour directed toward the runout gap and arranged behind the tongue member so that when the moving means moves the tongue member out of the runout gap the guide device faces the runout gap to guide a product for the production of products with two cross-folds.

2. A folder as defined in claim 1, wherein the tongue bar has a recess in the guide surface, the moving means the tongue member being operative to swing the tongue member out of the runout gap into the recess of the tongue bar, and further comprising movable wall means, to which the tongue member and the tongue bar are connected, for moving the tongue and the tongue bar away from the gripper/folding knife cylinder.

3. A folder as defined in claim 2, wherein the movable wall means includes two walls and a shaft rotatably mounted to the walls, the tongue member being attached to the shaft, and further comprising drive means for rotating the shaft.

4. A folder as defined in claim 3, wherein the drive means includes, for each end of the shaft, a lever attached to the shaft at its respective end, a crank rotatably mounted on the wall, coupling means for connecting the lever to the crank, and a working cylinder swingably mounted to the wall and connected to the crank.

5. A folder as defined in claim 4, wherein the crank is configured to assume an over-dead-center position when the tongue member is swung into the runout gap.

6. A folder as defined in claim 3, wherein the drive means includes a rotatory working cylinder provided so as to act at respective end regions of the shaft.

7. A folder as defined in claim 3, wherein the drive means includes a toothed gear attached to the shaft, and a reversible motor in drive-connection with the toothed gear.

8. A folder as defined in claim 2, wherein the movable wall means includes two walls and, for each wall, a side wall mounted parallel to the wall, two parallel, equal length levers rotatably mounted in articulated fashion on the side wall, and a working cylinder having one end articulated to the side wall and a second end connected to the wall.

9. A folder as defined in claim 1, wherein the guide device is integral with the tongue bar.

* * * * *